US011215185B2

(12) United States Patent
Yamasaki et al.

(10) Patent No.: US 11,215,185 B2
(45) Date of Patent: Jan. 4, 2022

(54) AXIAL FAN

(71) Applicant: Nidec Corporation, Kyoto (JP)

(72) Inventors: Yuta Yamasaki, Kyoto (JP); Hideki Aoi, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 36 days.

(21) Appl. No.: 16/751,241

(22) Filed: Jan. 24, 2020

(65) Prior Publication Data

US 2020/0271117 A1 Aug. 27, 2020

(30) Foreign Application Priority Data

Feb. 22, 2019 (JP) ..... JP2019-030529

(51) Int. Cl.
*F04D 19/00* (2006.01)
*F04D 29/32* (2006.01)
*F04D 29/52* (2006.01)

(52) U.S. Cl.
CPC ..... *F04D 19/002* (2013.01); *F04D 29/325* (2013.01); *F04D 29/522* (2013.01)

(58) Field of Classification Search
CPC ..... F04D 19/002; F04D 29/325; F04D 29/522
See application file for complete search history.

(56) References Cited

U.S. PATENT DOCUMENTS 9,028,223 B2 * 5/2015 Kitamura ..... F04D 25/0606 417/353
9,957,965 B2 * 5/2018 Yamagata ..... F04D 19/002
2007/0065064 A1 * 3/2007 Kitamura ..... F16C 19/54 384/537
2009/0196770 A1 * 8/2009 Yu ..... F04D 29/056 417/353
2010/0073873 A1 * 3/2010 Horng ..... H02K 9/06 361/695
2011/0318200 A1 12/2011 Takeshita

FOREIGN PATENT DOCUMENTS

CN 102312865 A 1/2012
JP 2009-216030 A 9/2009
JP 2016-125345 A 7/2016

OTHER PUBLICATIONS

Official Communication issued in corresponding Chinese Patent Application No. 202010085278.9, dated Feb. 24, 2021.

* cited by examiner

*Primary Examiner* — Patrick Hamo
(74) *Attorney, Agent, or Firm* — Keating & Bennett

(57) ABSTRACT

An axial fan includes a rotor, a rotor blade, a stator, and a housing. The housing includes a stator holder made of metal, a base made of metal and widened outwardly in a radial direction from a lower end portion of the stator holder, a rib extending outwardly in the radial direction from the base, and a housing cylinder connected to a radial-directional outer end portion of the rib. The housing cylinder extends in an axial direction and accommodates the rotor blade therein. A wind tunnel space in which air flows is provided between the base and the housing cylinder in the radial direction. A radial-directional outer side surface of the base is exposed in the wind tunnel space.

9 Claims, 4 Drawing Sheets

AXIAL FAN

CROSS REFERENCE TO RELATED APPLICATION

The present invention claims priority under 35 U.S.C. § 119 to Japanese Application No. 2019-030529 filed on Feb. 22, 2019, the entire contents of which are hereby incorporated herein by reference.

FIELD OF THE INVENTION

The present disclosure relates to an axial fan.

BACKGROUND

As a means for dissipating heat generated in a motor part in an axial fan, it can be considered that a motor housing is made of metal. However, the motor housing made of metal is more expensive and heavier than a motor housing made of resin. In this regard, for example, it is known an axial fan with a motor to which an impeller is mounted inside a fan frame including a two-body structure of a resin frame and a metal frame. At a center of the resin frame, a motor base on which the motor is arranged is provided. In addition, the resin frame has a quadrangular shape or substantially quadrangular shape and has fitting parts provided at four corner regions and extending in an axial direction. The metal frame is quadrangular or substantially quadrangular shape, and through-holes are defined in four corner regions. By fitting the fitting parts of the resin frame into the through-holes of the metal frame, the resin frame and the metal frame are connected to each other.

In the axial fan, air flows in an axial direction in a wind tunnel formed between the motor and a part of the housing surrounding the motor. For this reason, heat radiation occurring at a part exposed to the wind tunnel is effective.

However, when a part of the housing in which the motor is disposed is made of resin, the heat conductivity toward the part exposed to the wind tunnel is lower than when the above part is made of metal. Therefore, there is a concern that heat generated in the motor cannot be sufficiently dissipated from the housing.

SUMMARY

An axial fan according to an example embodiment of the present disclosure may include a rotor that is rotatable about a central axis extending in a vertical direction, a rotor blade that is rotatable together with the rotor, a stator to drive the rotor, and a housing to support the stator. The housing may include a metallic stator holder extending in the axial direction, and supporting the stator, a metallic base widened outwardly in the radial direction from a lower end portion of the stator holder, a rib extending outwardly in the radial direction from the base and facing the rotor blade in the axial direction, and a housing cylinder including at least a portion made of resin and connected to a radial-directional outer end portion of the rib. The housing cylinder may extend in the axial direction and accommodate the rotor blade therein. A wind tunnel space in which air flows in the axial direction by the rotor blade is provided between the base and the housing cylinder in the radial direction. A radial-directional outer side surface of the base is exposed in the wind tunnel space.

The above and other elements, features, steps, characteristics and advantages of the present disclosure will become more apparent from the following detailed description of the example embodiments with reference to the attached drawings.

DETAILED DESCRIPTION

Hereinafter, example embodiments of the present disclosure are described with reference to the accompanying drawings.

In the present specification, in the axial fan 100, a direction parallel to a central axis CA is referred to as an "axial direction". In the axial direction, a direction from a base 420 of a housing 400 to a shaft holder 211, which will be described later, is referred to as an "upward direction", and a direction from the shaft holder 211 to the base 420 is referred to as a "downward direction". In each component, an end part of an upward side is referred to as an "upper end part", and a position of the upper end part in the axial direction is referred to as an "upper end". Further, an end part of a downward side is referred to as a "lower end part", and a position of the lower end part in the axial direction is referred to as a "lower end". Further, in surfaces of components, an upward-facing surface is referred to as an "upper surface", and a downward-facing surface is referred to as a "lower surface".

A direction orthogonal to the central axis CA is referred to as a "radial direction". In the radial direction, a direction approaching the central axis CA is referred to as "inwardly in the radial direction", and a direction away from the central axis CA is referred to as "outwardly in the radial direction". In each component, a radially inward end part is referred to as a "radial-directional inner end part", and a position of the radial-directional inner end part is referred to as a "radial-directional inner end". Furthermore, a radially outward end part is referred to as a "radial-directional outer end part", and a position of the radial-directional outer end part is referred to as a "radial-directional outer end". In addition, in side faces of each component, an inward-facing side face is referred to as a "radial-directional inner side face", and an outward-facing side face is referred to as a "radial-directional outer side face".

A direction along a circumference about the central axis CA is referred to as a "circumferential direction".

In addition, in this specification, the term "annular shape" includes an arch shape having a discontinuity on a part of an entire circumference about the central axis CA, in addition to a shape that is continuously connected without any discontinuity across an entire circumference in the circumferential direction about the central axis CA.

In addition, it should be understood that the explanation described above is not strictly applied when the axial fan is assembled to actual equipment.

Figure 1:
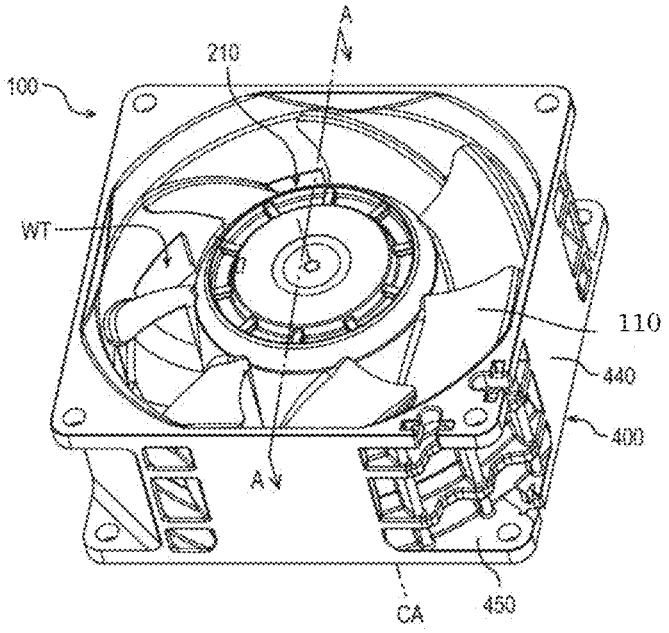
FIG. 1 is a perspective view of an axial fan according to an example embodiment of the present disclosure.
Figure 2:
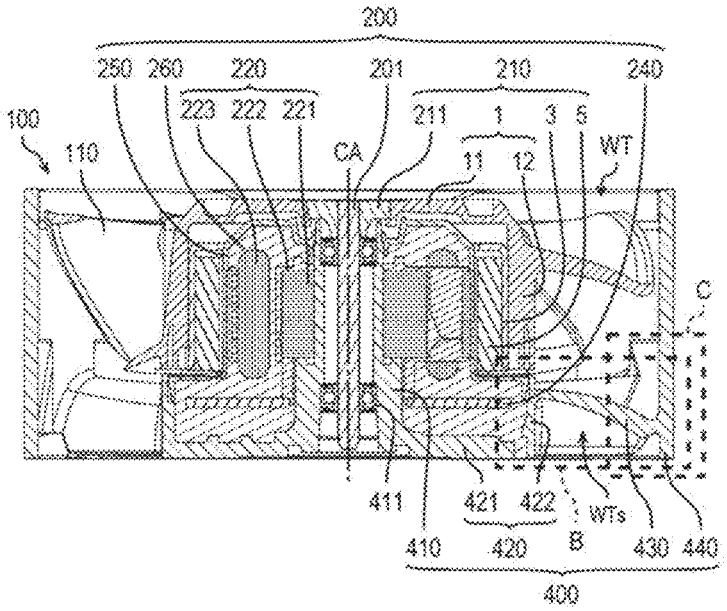
FIG. 2 is a cross-sectional view showing a configuration example of the axial fan according to an example embodiment of the present disclosure.

FIG. 1 is a perspective view of an axial fan 100 according to an example embodiment of the present disclosure. FIG. 2 is a cross-sectional view illustrating a configuration example of the axial fan 100 according to an example embodiment of the present disclosure. FIG. 2 is a cross-sectional view taken along line A-A line of FIG. 1 and shows a cross-sectional structure of the axial fan 100 in the case where the axial fan 100 is cut by an imaginary plane including a central axis CA.

The axial fan 100 is an air blower that causes air to flow in an axial direction by rotation of a rotor blade 110. As shown in FIGS. 1 and 2, the axial fan 100 includes the rotor blade 110, an outer rotor type motor 200, and a housing 400. The rotor blade 110, and a rotor 210 (which will be described later) of the motor 200 are parts of a single member. The rotor blade 110 is rotatable together with the rotor 210 about the central axis CA extending in a vertical direction. The motor 200 drives and rotates the rotor blade 110. The housing 400 supports a stator 220 (which will be described later) of the motor 200. In addition, a configuration of the housing 400 will be described later.

In addition, the axial fan 100 according to an example embodiment of the present disclosure is a fan motor, and the rotor blade 110 and a holder 1 (which will be described later) of the rotor 210 are parts of a single member. However, the present disclosure is not limited to an example of the above example embodiment of the present disclosure, and the rotor blade 110 may be a member different from the holder 1. In this case, for example, the axial fan 100 may further include an impeller having the rotor blade 110 and an impeller base attached to the holder 1, with the rotor blade being provided on the impeller base.

Next, a configuration of the motor 200 is described with reference to FIGS. 1 and 2. The motor 200 includes a shaft 201, the rotor 210, the stator 220, a substrate 240, a cover 250, and a resin filling part 260.

The shaft 201 is a rotation axis of the rotor blade 110 and the rotor 210. The shaft 201 is rotatable together with the rotor blade 110 and the rotor 210 about the central axis CA extending in the vertical direction. The present disclosure is not limited to the above example, and the shaft 201 may be a fixed axis attached to the stator 220. In addition, when the shaft 201 is a fixed axis, a bearing for the rotor 210 is provided between the shaft 201 and the rotor 210.

The rotor 210 is rotatable about the central axis CA extending in the vertical direction. The axial fan 100 is provided with the rotor 210. The rotor 210 has a shaft holder 211, the cylindrical holder 1 having a lid, a rotor yoke 3, and a magnet 5.

The shaft holder 211 is attached to the shaft 201 at an axial-directional upper part of the motor 200. In an example embodiment of the present disclosure, the shaft holder 211 is attached to an axial-directional upper end part of the shaft 201 and is widened outwardly in the radial direction from a radial-directional outer side face of the shaft 201.

The holder 1 holds the magnet 5. More specifically, the holder 1 holds the magnet 5 by interposing the rotor yoke 3. The holder 1 has a top plate 11 and a cylinder 12.

The top plate 11 has a plate shape which is widened in the radial direction. More specifically, the top plate 11 has a circular disk shape or substantially circular disk shape centered on the central axis CA and having an opening at a center thereof, and is widened from a radial-directional outer end part of the shaft holder 211 in the radial direction.

The cylinder 12 extends downwardly from a radial-directional outer end part of the top plate 11. The plurality of rotor blades 110 are provided on a radial-directional outer side face of the cylinder 12. The rotor yoke 3 is provided on a radial-directional inner side face of the cylinder 12.

The rotor yoke 3 is formed using a magnetic material. The rotor yoke 3 has a cylindrical shape or substantially cylindrical shape extending in the axial direction and holds the magnet 5. The rotor yoke 3 is provided on a radial-directional inner face of the holder 1. The magnet 5 is provided on a provided on a radial-directional inner face of the rotor yoke 3.

The magnet 5 is disposed outwardly in the radial direction from the stator 220 and faces the stator 220 in the radial direction. The magnet 5 has different magnetic poles, that is, N pole and S pole. The N pole and the S pole are alternately arranged in the circumferential direction. In an example embodiment of the present disclosure, the magnet 5 has an annular shape or substantially annular shape centered on the central axis CA. However, the magnet 5 is not limited to the above example and may include a plurality of segment magnets arranged in the circumferential direction.

Next, the stator 220 drives the rotor 210. The axial fan 100 is provided with the stator 220. More specifically, the stator 220 drives and rotates the rotor 210 in the circumferential direction when the motor 200 is driven. The stator 220 has an annular shape or substantially annular shape centered on the central axis CA.

The stator 220 includes a stator core 221, an insulator 222, and a plurality of coils 223. The stator core 221 is an annular or substantially annular magnetic body centered on the central axis CA, and, in an example embodiment of the present disclosure, the stator core is a stacked body in which a plurality of plate-shaped electromagnetic steel plates are stacked. In an example embodiment of the present disclosure, a radial-directional inner end part of the stator core 221 is fixed to a radial-directional outer side face of a stator holder 410 (which will be described later) of the housing 400. A radial-directional outer side face of the stator core 221 faces the magnet 5 in the radial direction. The insulator 222 covers at least a part of the stator core 221. The insulator 222 is an insulating member using a resin material or the like. Each of the plurality of coils 223 is a winding member in which a conducting wire (reference numeral therefor is omitted) is wound around the stator core 221 by interposing the insulator 222. An end part of the conducting wire is electrically connected to the substrate 240.

The substrate 240 is electrically connected to the conducting wire of the coils 223 and a connecting wire (not shown) drawn to the outside of the housing 400. In an example embodiment of the present disclosure, the substrate 240 is accommodated in the base 420.

The cover 250 has a cylindrical shape with a lid or substantially cylindrical shape with a lid and accommodates the stator 220. The cover 250 covers an opening (reference number thereof is omitted) formed in an upper end of the base 420. A lid (not shown) of the cover 250 has a disk shape or substantially disk shape centered on the central axis CA and having an opening formed in a center thereof, and is widened in the radial direction. The shaft 201 and the stator holder 410 are inserted into and pass through the opening formed at the center of the lid. A cylinder (reference numeral thereof is omitted) of the cover 250 extends downwardly from a radial-directional outer end part of the lid. In an example embodiment of the present disclosure, a lower end part of the cylinder is fitted into an upper end part of an outer cylinder 422. However, the present disclosure is not limited to the above example, and the lower end part of the cylinder may be coupled to the upper end part of the outer cylinder 422 by, for example, snap fit, or the like.

In an example embodiment of the present disclosure, the resin filling part 260 fills the inside of the base 420 and the cover 250 with a resin material. The resin filling part 260 covers at least a part of the stator 220. Furthermore, the resin filling part 260 also covers the substrate 240 and the like. In this way, it is possible to enhance the waterproofness and dustproofness of the stator through the resin filling part 260. In addition, heat generated in the stator 220 is transferred to a metal part (which will be described later) of the housing 400 and then dissipated. Therefore, overheating of the stator 220 caused by the resin filling part 260 may be suppressed.

Next, a configuration of the housing 400 is described with reference to FIGS. 1 and 2. A part of the housing 400 is made of resin. The remaining part of the housing 400 is made of metal. The material of the metal part of the housing 400 is preferably a non-magnetic material. For example, an aluminum alloy such as ADC12, a magnesium alloy, zinc and alloy thereof, austenitic stainless steel, or the like may be used as the above-described material.

The housing 400 includes the stator holder 410, the base 420, a rib 430, a housing cylinder 440, and a flange 450.

The stator holder 410 is made of metal and has a cylindrical shape or substantially cylindrical shape extending in the axial direction. The stator holder 410 supports the stator 220. The stator holder 410 is provided with a bearing 411. The bearings 411 are arranged at upper and lower parts inside the stator holder 410. Further, the shaft 201 is inserted into the stator holder 410 and the bearings 411. The stator holder 410 rotatably supports the shaft 201 by interposing the bearing 411. In an example embodiment of the present disclosure, the bearing 411 is a ball bearing, but the present disclosure is not limited to the above example and may be a sleeve bearing, or the like.

The base 420 is made of metal and widened outwardly in the radial direction from a lower end part of the stator holder 410. The base 420 has a cylindrical shape with a bottom or substantially cylindrical shape with a bottom. The base 420 has a bottom lid 421 and the outer cylinder 422. The bottom lid 421 has a disk shape or substantially disk shape centered on the central axis CA and having an opening formed at a center thereof, and is widened outwardly in the radial direction from the lower end part of the stator holder 410. The outer cylinder 422 has a cylindrical shape or substantially cylindrical shape that extends upwardly from a radial-directional outer end part of the bottom lid 421.

The rib 430 connects the base 420 and the housing cylinder 440. In an example embodiment of the present disclosure, the plurality of ribs 430 are provided. The rib 430 extends outwardly in the radial direction from the base 420 and faces the rotor blade 110 in the axial direction. An inner edge of the rib 430 in the radial direction is connected to a radial-directional outer side face of the base 420. Further, an outer edge of the rib 430 in the radial direction is connected to a radial-directional inner side face of the housing cylinder 440.

The rib 430 extends in the axial direction and is inclined in the rotational direction of the rotor blade 110 as going downwardly. The rib 430 functions as a stationary blade, and rectifies the flow of air directed from an upper side to a lower side by a rotation of the rotor blade 110. Further, air flow strikes a positive pressure surface of the rib 430 over a wide area. For that reason, even in the rib 430, it is possible to dissipate the transferred heat. Such an effect is particularly effective, for example when at least a part of the rib 430 is made of metal.

At least a part of the housing cylinder 440 is made of resin. The housing cylinder 440 is connected to a radial-directional outer end part of the rib 430 and holds the base 420 by interposing the rib 430. The housing cylinder 440 extends in the axial direction and accommodates the rotor blade 110. In addition, in an example embodiment of the present disclosure, the housing cylinder 440 accommodates the motor 200, the stator holder 410, the base 420, the rib 430, and the like therein. A wind tunnel (WT) extending in the axial direction is provided between the cylinder 12 of the motor 200 and the housing cylinder 440 and between the outer cylinder 422 (which is described later) and the housing cylinder 440 of the housing 400. When the axial fan 100 is driven, air flows downwardly in the wind tunnel (WT) by rotation of the rotor blade 110.

In the radial direction, a partial space of a wind tunnel (WT) in which air flows in the axial direction by the rotor blade 110 is provided between the base 420 and the housing cylinder 440. Hereinafter, the partial space is referred to as a wind tunnel space (WTs). In the wind tunnel space (WTs), the radial-directional outer side face of the base 420 is exposed.

As described above, since the stator holder 410 and the base 420 are made of metal, heat generated in the stator 220 and the like is efficiently transferred to the base 420 via the stator holder 410. The heat transferred to the base 420 is dissipated from the radial-directional outer side face of the base 420 facing the wind tunnel space (WTs). Therefore, the heat dissipation of the housing 400 can be improved.

Furthermore, a material of the stator holder 410 and a material of the base 420 are preferably the same metal material. In this way, as compared with the case where materials of both elements differ from each other, a bonding strength force between both elements due to a change in temperature or an aging variation is not easily changeable and thereby such bonding strength force is stable. Therefore, generation of vibration and noise in the stator holder 410 and the base 420 can be suppressed. However, the present disclosure is not limited to the example of the above example embodiment, and materials of both elements may differ from each other.

In an example embodiment of the present disclosure, the stator holder 410 and the base 420 are parts of a single member. In this case, heat transferred from the stator 220 to the base 420 via the stator holder 410 is better conducted, as compared with the case where the stator holder 410 and the base 420 are disparate members. Therefore, more heat may be dissipated from the radial-directional outer side face of the base 420 facing the wind tunnel space (WTs). Further, as compared with a configuration in which the stator holder 410 and the base 420 are disparate bodies, rigidity of the housing 400 is higher. Therefore, generation of vibration and noise in the stator holder 410 and the base 420 can be effectively suppressed. Furthermore, a process of assembling the stator holder 410 and the base 420 may be omitted.

However, the present disclosure is not limited to the example of the above example embodiment, the stator holder 410 and the base 420 may be disparate members. Even in this way, when materials of both elements are the same, as compared with the case where materials of both elements differ from each other, a bonding strength force between both elements due to a change in temperature or an aging variation is not easily changeable and thereby such bonding strength force is stable. Therefore, it is possible to make it difficult for vibration and noise to be generated. However, both elements may be disparate members made of different materials.

The flange 450 extends outwardly in the radial direction from a lower end part of the housing cylinder 440 (see FIG. 1).

Next, a configuration of a metal part of the housing 400 is described with reference to the first to fourth example embodiments of the present disclosure.

Figure 3:
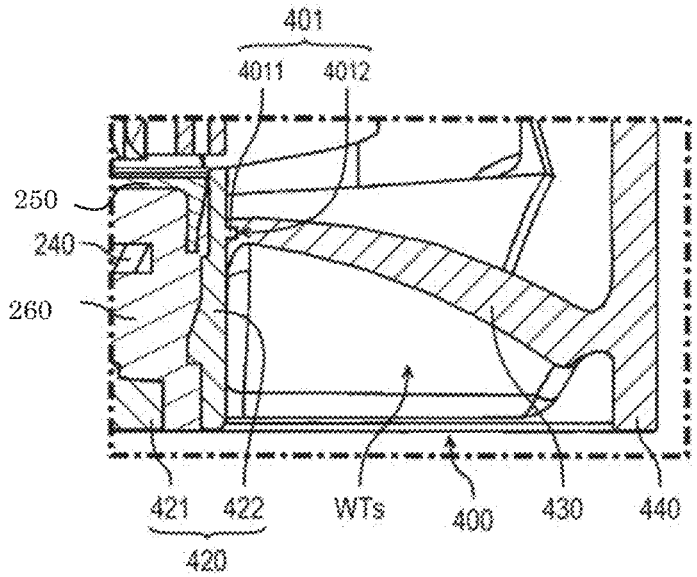
FIG. 3 is a partial cross-sectional view of a housing according to a first example embodiment of the present disclosure.

FIG. 3 is a partial cross-sectional view of the housing 400 according to the first example embodiment of the present disclosure. FIG. 3 corresponds to a part B surrounded by a broken line in FIG. 2, and a partial cross-section of the housing 400 taken along line A-A in FIG. 1 is viewed in the circumferential direction.

In the first example embodiment of the present disclosure, as shown in FIG. 3, the housing 400 further includes a first connector 401. The first connector 401 is provided between an outer edge of the base 420 in the radial direction and the inner edge of the rib 430 in the radial direction. The first connector 401 connects the base 420 and the rib 430. A first convexity 4011 and a first concavity 4012 are provided on the first connector 401.

In FIG. 3, the base 420 has the first convexity 4011. The first convexity 4011 is provided on the outer edge of the base 420 in the radial direction, and more specifically, provided on a radial-directional outer side face of the outer cylinder 422. The first convexity 4011 protrudes from the outer edge of the base 420 in the radial direction to the inner edge of the rib 430 in the radial direction. Also, in FIG. 3, the rib 430 has the first concavity 4012. The first concavity 4012 is provided on the inner edge of the rib 430 in the radial direction, and is concave in a direction which is the same as a direction in which the first convexity 4011 protrudes. However, the present disclosure is not limited to the example in FIG. 3, the base 420 may have the first concavity 4012 and the rib 430 may have the first convexity 4011.

In the first connector 401, that is, the first convexity 4011 may be provided on one side of the outer edge of the base 420 in the radial direction and the inner edge of the rib 430 in the radial direction. In this case, the first convexity 4011 protrudes from the one side toward the other side. Moreover, the first concavity 4012 may be formed on the other side. In this case, the first concavity 4012 is concave in a direction which is the same as that in which the first convexity 4011 protrudes.

In the first connector 401, the first convexity 4011 is accommodated in the first concavity 4012 and is inserted into and held by the first concavity 4012 in the axial direction. In this way, for example, even when the base 420 and the rib 430 are formed of different materials, the first concavity 4012 receives and holds the first convexity 4011 in the axial direction such that both the base and the rib may be firmly fixed. Such a structure may be realized by, for example, an outsert molding process, and the like. Here, in FIG. 3, by fitting the first convexity 4011 into the first concavity 4012 in the radial direction, both the base and the rib are connected. However, the present disclosure is not limited to the example of FIG. 3, and the first convexity 4011 may be fitted into the first concavity 4012 in the axial direction or the circumferential direction so as to connect both elements.

In addition, in FIG. 3, the rib 430 is made of resin. Furthermore, the housing cylinder 440 is also made of resin, and both the rib and the housing cylinder are parts of a single member. That is, the outer edge of the rib 430 in the radial direction is continuously connected to the radial-directional inner side face of the housing cylinder 440.

However, the present disclosure is not limited to this example, and at least a part of the rib 430 may be made of metal. More specifically, at least some rib 430 of the plurality of ribs 430 may be metallic. In this way, heat generated in the stator 220 and the like is favorably transferred to the metallic rib 430 via the stator holder 410 and the base 420. Since air flowing in the axial direction through the wind tunnel space (WTs) between the base 420 and the housing cylinder 440 hits the metallic rib 430, so sufficient heat may be dissipated. Therefore, heat dissipation of the housing 400 may be further improved.

For the metallic rib 430, a metal material which is the same as that of the base 420 is preferably used. In this way, it is possible to reduce manufacturing cost. However, the present disclosure is not limited to this example, and a metal material which differs from that of the base 420 may be used for the metal rib 430.

Figure 4:
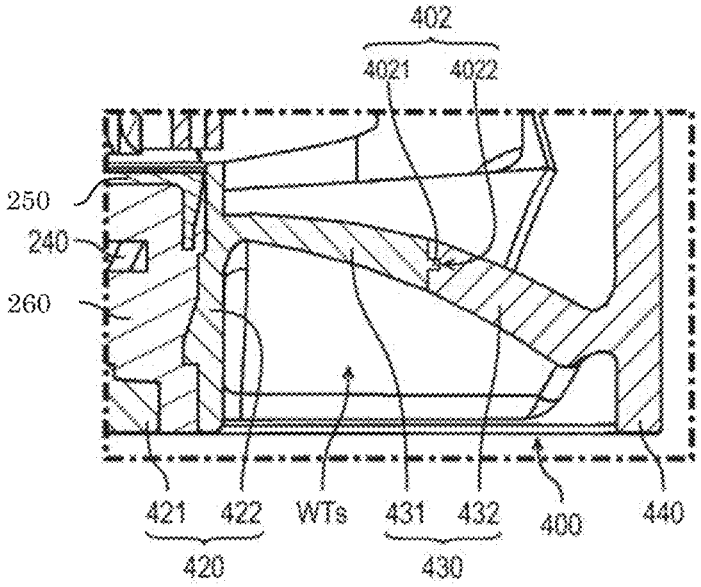
FIG. 4 is a partial cross-sectional view of a housing according to a second example embodiment of the present disclosure.

FIG. 4 is a partial cross-sectional view of the housing 400 according to the second example embodiment of the present disclosure. FIG. 4 corresponds to a part B surrounded by a broken line in FIG. 2, and a partial cross-section of the housing 400 taken along line A-A in FIG. 1 is viewed in the circumferential direction.

In the second example embodiment of the present disclosure, at least a part of the rib 430 is made of metal. More specifically, as shown in FIG. 4, a part of one rib 430 is made of metal. In this way, heat generated in the stator 220 and the like is favorably transferred to the metal part of the rib 430 via the stator holder 410 and the base 420. Since air flowing in the axial direction in the wind tunnel space (WTs) between the base 420 and the housing cylinder 440 hits this metal part, sufficient heat radiation may be performed. Accordingly, even in this case, the heat dissipation of the housing 400 may be further improved.

In the second example embodiment of the present disclosure, as shown in FIG. 4, the rib 430 includes a first rib piece 431 made of metal and a second rib piece 432 made of resin.

The first rib piece 431 and the base 420 are parts of a single member. For that reason, an inner edge of the first rib piece 431 in the radial direction is continuously connected to the outer edge of the base 420 in the radial direction. However, the present disclosure is not limited to the example of FIG. 4, and like as the first example embodiment, the inner edge of the first rib piece 431 in the radial direction may be connected to the outer edge of the base 420 in the radial direction by the first connector 401.

The second rib piece 432 and the housing cylinder 440 are parts of a single member. Here, in FIG. 4, the housing cylinder 440 is made of resin. For that reason, an outer edge of the second rib piece 432 in the radial direction is continuously connected to an inner edge of the housing cylinder 440 in the radial direction. However, the present disclosure is not limited to the example of FIG. 4, or like as the third example embodiment described later, the outer edge of the second rib piece 432 in the radial direction may be connected to the inner edge of the housing cylinder 440 in the radial direction by a third connector 403.

The housing 400 further includes a second connector 402. The second connector 402 is provided between an outer edge of the first rib piece 431 in the radial direction and an inner edge of the second rib piece 432 in the radial direction, and connects the first rib piece 431 and the second rib piece 432. A second convexity 4021 and a second concavity 4022 are provided on the second connector 402.

In FIG. 4, the first rib piece 431 has the second convexity 4021. The second convexity 4021 is provided on the outer edge of the first rib piece 431 in the radial direction, and protrudes from the outer edge of the first rib piece 431 in the radial direction toward the inner edge of the second rib piece 432 in the radial direction. In addition, in FIG. 4, the second rib piece 432 includes the second concavity 4022. The second concavity 4022 is provided at the inner edge of the second rib piece 432 in the radial direction, and is concave in a direction which is the same as a direction in which the second convexity 4021 protrudes. However, the present disclosure is not limited to the example of FIG. 4, and the first rib piece 431 may include the second concavity 4022 and the second rib piece 432 may include the second convexity 4021.

That is, in the second connector 402, the second convexity 4021 may be provided on one side of the outer edge of the first rib piece 431 in the radial direction and the inner edge of the second rib piece 432 in the radial direction. In this case, the second convexity 4021 protrudes from the one side toward the other side. Further, the second concavity 4022 may be provided on the other side. In this case, the second concavity 4022 is concave in a direction which is the same as a direction in which the second convexity 4021 protrudes.

In the second connector 402, the second convexity 4021 is accommodated in the second concavity 4022 and is inserted into and held by the second concavity 4022 in the axial direction. In this way, for example, even when the first rib piece 431 and the second rib piece 432 are formed of different materials, the second concavity 4022 receives and holds the second convexity 4021 in the axial direction such that both elements may be firmly fixed. Such a structure may be realized by an outsert molding process, and the like. Here, in FIG. 4, by fitting the second convexity 4021 into the second concavity 4022 in the radial direction, both elements are connected. However, the present disclosure is not limited to the example of FIG. 4, and the second convexity 4021 may be fitted into the second concavity 4022 in the axial direction or the circumferential direction such that both elements may be connected.

Figure 5:
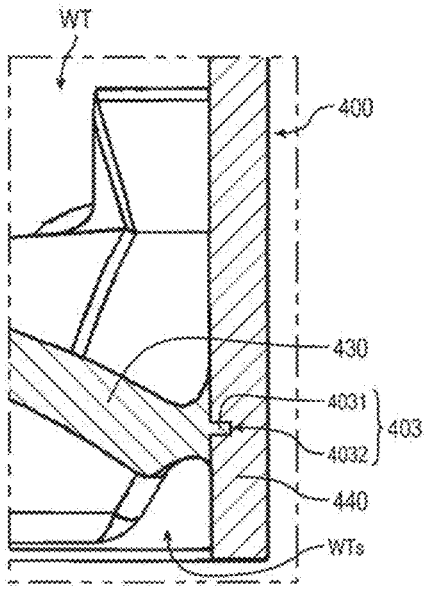
FIG. 5 is a partial cross-sectional view of a housing according to a third example embodiment of the present disclosure.

FIG. 5 is a partial cross-sectional view of the housing 400 according to the third example embodiment of the present disclosure. FIG. 5 corresponds to a part C surrounded by a broken line in FIG. 2, and a partial cross-section of the housing 400 taken along line A-A in FIG. 1 is viewed in the circumferential direction.

In the third example embodiment, at least a part of the rib 430 is made of metal, and the housing cylinder 440 is made of resin. As shown in FIG. 5, the housing 400 further includes the third connector 403. The third connector 403 is provided between the outer edge of the rib 430 in the radial direction and the inner edge of the housing cylinder 440 in the radial direction. The third connector 403 connects the rib 430 and the housing cylinder 440. A third convexity 4031 and a third concavity 4032 are provided on the third connector 403.

In FIG. 5, the rib 430 has the third convexity 4031. The third convexity 4031 is provided on the outer edge of the rib 430 in the radial direction. The third convexity 4031 protrudes from the outer edge of the rib 430 in the radial direction to the inner edge of the housing cylinder 440 in the radial direction. In addition, in FIG. 5, the housing cylinder 440 includes the third concavity 4032. The third concavity 4032 is provided on the inner edge of the housing cylinder 440 in the radial direction, and is concave in a direction which is the same as a direction in which the third convexity 4031 protrudes. However, the present disclosure is not limited to the example in FIG. 5, the rib 430 may have the third concavity 4032 and the housing cylinder 440 may have the third convexity 4031.

That is, in the third connector 403, the third convexity 4031 may be provided on one side of the outer edge of the rib 430 in the radial direction and the inner edge of the housing cylinder 440 in the radial direction. In this case, the third convexity 4031 protrudes from the one side toward the other side. Further, the third concavity 4032 may be provided on the other side. In this case, the third concavity 4032 is concave in a direction which is the same as a direction in which the third convexity 4031 protrudes.

In the third connector 403, the third convexity 4031 is accommodated in the third concavity 4032 and is inserted into and held by the third concavity 4032 in the axial direction. In this way, for example, even when the rib 430 and the housing cylinder 440 are formed of different materials, the third concavity 4032 receives and holds the third convexity 4031 in the axial direction both elements may be firmly fixed. Such a structure may be realized by an outsert molding process, and the like. Here, in FIG. 5, by fitting the third convexity 4031 into the third concavity 4032 in the radial direction, both elements are connected. However, the present disclosure is not limited to the example of FIG. 5, and the third convexity 4031 may be fitted into the third concavity 4032 in the axial direction or the circumferential direction so as to connect both elements.

Also, in the third example embodiment of the present disclosure, the rib 430 and the base 420 may be parts of a single member. Further, a material of the rib 430 may be a metal material which is the same as that of the base 420. That is, the inner edge of the rib 430 in the radial direction may be continuously connected to the outer edge of the base 420 in the radial direction.

Alternatively, in the third example embodiment of the present disclosure, the first connector 401 similar to that in the first example embodiment may be provided between the outer edge of the base 420 in the radial direction and the inner edge of the rib 430 in the radial direction. That is, the inner edge of the rib 430 in the radial direction may be fixed to the outer edge of the base 420 in the radial direction by inserting and holding the first convexity 4011 into and by the first concavity 4012.

Alternatively, in the third example embodiment of the present disclosure, the rib 430 may include the first rib piece 431 and the second rib piece 432. At this time, the first rib piece 431 and the base 420 are parts of a single member, and the second rib piece 432 is connected to the housing cylinder 440 by the third connector 403. Further, the second connector 402 similar to that of the second example embodiment may be defined between the outer edge of the first rib piece 431 in the radial direction and the inner edge of the second rib piece 432 in the radial direction. That is, the outer edge of the first rib piece 431 in the radial direction may be fixed to the inner edge of the second rib piece 432 in the radial direction by inserting and holding the second convexity 4021 into and by the second concavity 4022. In this case, the outer edge of the second rib piece 432 in the radial direction is connected to the inner edge of the housing cylinder 440 in the radial direction by the third connector 403.

Figure 6A:
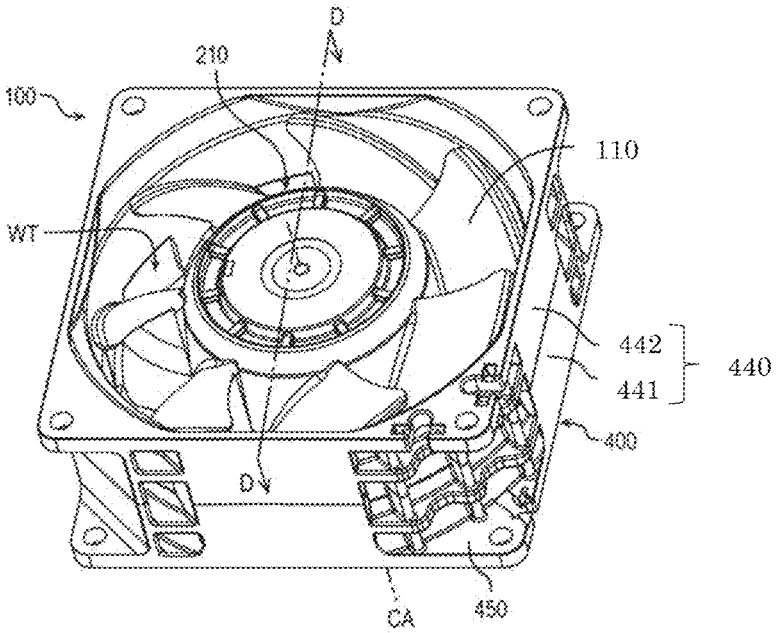
FIG. 6A is a perspective view of an axial fan according to a fourth example embodiment of the present disclosure.
Figure 6B:
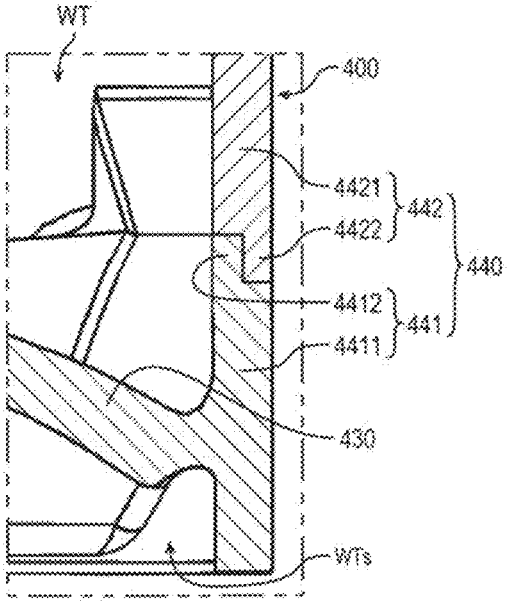
FIG. 6B is a partial cross-sectional view of a housing according to the fourth example embodiment of the present disclosure.

FIG. 6A is a perspective view of the axial fan 100 according to a fourth example embodiment of the present disclosure, and FIG. 6B is a partial cross-sectional view of the housing 400 according to the fourth example embodiment of the present disclosure. FIG. 6B corresponds to a part C surrounded by a broken line in FIG. 2, and a partial cross-section of the housing 400 taken along line D-D in FIG. 6A is viewed in the circumferential direction.

In the fourth example embodiment of the present disclosure, at least a part of the rib 430 is made of metal. The housing cylinder 440 includes a first housing cylinder 441 which are made of metal and a second housing cylinder 442. The second housing cylinder 442 is attached to an upper end part of the first housing cylinder 441. The first housing cylinder 441 and the rib 430 or metal parts thereof are parts of a single member. At least a part of the second housing cylinder 442 is made of resin.

Having a part of the housing cylinder 440 to be made of metal makes it possible to enhance rigidity of the housing cylinder 440. For that reason, since thickness of the housing cylinder 440 may be thinner, the radial-directional size of the wind tunnel space (WTs) between the base 420 and the housing cylinder 440 can be increased further and thereby to enlarge an air flowing area further.

Further, heat generated by the stator 220 and the like and transferred via the stator holder 410, the base 420, and the rib 430 made of metal may also be favorably dissipated from the first housing cylinder 441. Therefore, the heat dissipation of the housing 400 may be further enhanced.

The first housing cylinder 441 includes a first cylinder 4411 extending in the axial direction and an inner wall 4412 having an annular shape or substantially annular shape. The inner wall 4412 protrudes upwardly from an upper face of the first cylinder 4411 and extends in the circumferential direction. In FIG. 6B, the inner wall 4412 protrudes from a radial-directional inner end part of the upper face of the first cylinder 4411.

The second housing cylinder 442 includes a second cylinder 4421 extending in the axial direction, and outer wall 4422 having an annular shape or substantially annular shape. The outer wall 4422 protrudes downwardly from a lower face of the second cylinder 4421 and extends in the circumferential direction. In FIG. 6B, the outer wall 4422 protrudes from a radial-directional outer end part of the lower face of the second cylinder 4421, and is disposed on a radial-directional outer side of the inner wall 4412.

A radial-directional outer side face of the inner wall 4412 is in contact with a radial-directional inner side face of the outer wall 4422. In this way, it is possible to more firmly connect the first housing cylinder 441 and the second housing cylinder 442. For example, when the first housing cylinder 441 made of metal and the second housing cylinder 442 made of resin are outsert-molded, the outer wall 4422 of the second housing cylinder 442 presses the inner wall 4412 of the first housing cylinder 441 toward the radial-directional inner side by heat shrinkage of the resin such that both the first and second housing cylinders may be firmly connected. Alternatively, the inner wall 4412 may be fitted into the inner side of the outer wall 4422. Alternatively, the inner wall 4412 may be inserted into and pass through the outer wall 4422, and may be bonded to the outer wall 4422 by using an adhesive or the like.

Further, as described above, the housing 400 includes the flange 450. In the fourth example embodiment of the present disclosure, the flange 450 extends outwardly in the radial direction from a lower end part of the first housing cylinder 441. The flange 450 is preferably made of metal, and more preferably made of metal which is the same as that of the first housing cylinder 441. In addition, more preferably, the flange 450 and the first housing cylinder 441 are parts of a single member. Having the flange 450 used for attachment of the axial fan 100 to be made of metal may further enhance heat dissipation of the housing 400. Furthermore, having the flange 450 and the first housing cylinder 441 to be parts of a single member may further improve heat dissipation of the housing 400. In addition, since the axial fan 100 may be firmly and securely attached, generation of vibration and noise may be more effectively suppressed.

The present disclosure is useful for an air blowing apparatus in which a part of the housing is exposed in a space through which air flows.

While example embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

What is claimed is:

1. An axial fan comprising:

a rotor that is rotatable about a central axis extending in a vertical direction;

a rotor blade that is rotatable together with the rotor;

a stator to drive the rotor; and a housing to support the stator; wherein the housing includes:

a stator holder made of metal and extending in an axial direction, and supporting the stator;

a base made of metal and widened outwardly in a radial direction from a lower end portion of the stator holder;

a rib extending outwardly in the radial direction from the base and facing the rotor blade in the axial direction; and a housing cylinder including at least a portion made of resin, and connected to a radial-directional outer end portion of the rib;

the housing cylinder extends in the axial direction and accommodates the rotor blade therein;

a wind tunnel space in which air flows in the axial direction by the rotor blade is provided between the base and the housing cylinder in the radial direction;

a radial-directional outer side surface of the base is exposed in the wind tunnel space;

the rib includes a first rib piece made of metal and a second rib piece made of resin;

the first rib piece and the base are defined a single unitary structure;

the second rib piece and the housing cylinder are defined by a single unitary structure;

a second connector connecting the first rib piece and the second rib piece is provided between an outer edge of the first rib piece in the radial direction and an inner edge of the second rib piece in the radial direction;

in the second connector, a second convexity is provided on one e of the outer edge of the first rib piece in the radial direction and the inner edge of the second rib piece in the radial direction, the second convexity protrudes from the on side toward another side;

a second concavity, which is concave in a direction that is the same as a direction in which the second convexity protrudes, is provided on the another side; and the second convexity is accommodated in the second concavity, and is inserted into and held by the second concavity hi the axial direction.

2. The axial fan of claim 1, wherein the stator holder and the base are defined by a single unitary structure.

3. The axial fan of claim 1, wherein a first connector connecting the base and the rib is provided between an outer edge of the base in the radial direction and an inner edge of the rib in the radial direction;

in the first connector, a first convexity is provided on one side of the outer edge of the base in the radial direction and the inner edge of the rib in the radial direction, the first convexity protrudes from the one side toward the another side;

a first concavity, which is concave in a direction that is the same as a direction in which the first convexity protrudes is provided on the another side; and the first convexity is accommodated in the first concavity, and is inserted into and held by the first concavity in the axial direction.

4. The axial fan of claim 1, wherein a third connector connecting the rib and the housing cylinder is provided between an outer edge of the rib in the radial direction and an inner edge of the housing cylinder in the radial direction;

in the third connector, a third convexity is provided on one side of the outer edge of the rib in the radial direction and the inner edge of the housing cylinder in the radial direction, the third convexity protrudes from the one side toward the another side;

a third concavity, which is concave in a direction that is the same as a direction in which the third convexity protrudes, is provided on the another side; and the third convexity is accommodated in the third concavity, and is inserted into and held by the third concavity in the axial direction.

5. The axial fan of claim 1, wherein the housing cylinder includes:

a first housing cylinder made of metal; and a second housing cylinder attached to an upper end portion of the first housing cylinder;

the first housing cylinder and the rib are defined by a single unitary structure.

6. The axial fan of claim 5, wherein the first housing cylinder includes:

a first cylinder extending in the axial direction; and an inner wall with an annular or substantially annular shape and protruding upwardly from an upper surface of the first cylinder and extending in a circumferential direction;

the second housing cylinder includes:

a second cylinder extending in the axial direction; and an outer wall with an annular or substantially annular shape and protruding downwardly from a lower surface of the second cylinder and extending in the circumferential direction; and a radial-directional outer side surface of the inner wall is in contact with a radial-directional inner side surface of the outer wall.

7. The axial fan of claim 5, wherein the housing includes a flange made of metal and extending outwardly in the radial direction from a lower end portion of the first housing cylinder.

8. The axial fan of claim 1, wherein the rib extends in the axial direction and is inclined in a rotational direction of the rotor blade as extending downwardly.

9. The axial fan of claim 1, further comprising a resin covering at least a portion of the stator.

* * * * *